US007371145B2

(12) United States Patent
Ridge et al.

(10) Patent No.: US 7,371,145 B2
(45) Date of Patent: May 13, 2008

(54) MULTIPURPOSE SOUVENIR KIT

(76) Inventors: Benjamin C. Ridge, 2745 Clapham La., P.O. Box 2288, Minden, NV (US) 89423; George G. Ridge, 2745 Clapham La., P.O. Box 2288, Minden, NV (US) 89423

( * ) Notice: Subject to any disclaimer, the term of this patent is extended or adjusted under 35 U.S.C. 154(b) by 0 days.

(21) Appl. No.: 11/107,694

(22) Filed: Apr. 14, 2005

(65) Prior Publication Data

US 2005/0255785 A1 Nov. 17, 2005

Related U.S. Application Data

(60) Provisional application No. 60/562,180, filed on Apr. 14, 2004.

(51) Int. Cl.
*A63H 33/00* (2006.01)
*A63H 33/08* (2006.01)

(52) U.S. Cl. ..... 446/71; 446/108

(58) Field of Classification Search ..... 446/71, 446/75, 77, 82, 108–110, 114–115, 476–479, 446/487–488; 206/223, 575, 736
See application file for complete search history.

(56) References Cited

U.S. PATENT DOCUMENTS

| | | | | | |
|---|---|---|---|---|---|
| 296,783 | A * | 4/1884 | Reed | 446/75 |
| 668,976 | A * | 2/1901 | Cannon | 446/108 |
| 2,249,495 | A * | 7/1941 | Reuter | 40/538 |
| 2,501,694 | A * | 3/1950 | Ruffin | 229/116.1 |
| 2,558,591 | A * | 6/1951 | Starck | 446/115 |
| 3,343,297 | A * | 9/1967 | Valentine | 446/109 |
| 3,982,352 | A * | 9/1976 | Branson | 446/96 |
| 4,425,725 | A * | 1/1984 | Moustakas et al. | 40/725 |
| D317,419 | S * | 6/1991 | Ronzheimer | D10/116 |
| 5,163,608 | A * | 11/1992 | Block | 229/92.8 |
| 6,130,384 | A * | 10/2000 | Esteves et al. | 174/66 |
| 6,422,560 | B1 * | 7/2002 | Harbaugh | 273/157 R |
| 6,871,433 | B2 * | 3/2005 | Anza' | 40/539 |
| 6,905,338 | B1 * | 6/2005 | Garran | 434/79 |
| 2002/0124449 | A1 * | 9/2002 | Hill | 40/611 |

(Continued)

FOREIGN PATENT DOCUMENTS

GB 2181064 A * 4/1987

OTHER PUBLICATIONS

International Search Report and Written Opinion from International Application No. PCT/US05/12753 mailed Jul. 14, 2006.

*Primary Examiner*—Eugene Kim
*Assistant Examiner*—Alyssa M Hylinski
(74) *Attorney, Agent, or Firm*—Klarquist Sparkman, LLP

(57) ABSTRACT

Souvenir kits are disclosed, the kits including an assortment of multiple parts including a front member, a rear member, and at least one side member. At least the front member is thematically representative of an aspect of a particular travel destination. At least the front member is configured for connection to one or more other parts in the kit in multiple respective ways so as to make a selected souvenir assembly of at least three possible souvenir assemblies, each having a different use, that can be made from the parts in the kit. Exemplary assemblies include bookends, wall-hangings, enclosures (e.g., planters), light-switch covers, object-holding devices, and wind chimes, and combinations thereof.

8 Claims, 10 Drawing Sheets

U.S. PATENT DOCUMENTS

2003/0208871 A1* 11/2003 Osborne ..... 15/209.1
2005/0185398 A1* 8/2005 Scannell, Jr. ..... 362/227
2006/0091036 A1* 5/2006 Casella ..... 206/457

* cited by examiner

MULTIPURPOSE SOUVENIR KIT

CROSS REFERENCE TO RELATED APPLICATIONS

This application claims the benefit of U.S. Provisional Application No. 60/562,180, filed Apr. 14, 2004, which application is incorporated herein in its entirety.

FIELD

This disclosure pertains to kits containing multiple parts that can be packaged and shipped in disassembled form and assembled together in different ways to make any of multiple objects having particular appeal as souvenirs and the like.

BACKGROUND

Many tourists purchase souvenirs when traveling, especially when traveling to a popular location or to a location proximal to a particular natural or man-made feature that is famous or well-recognized. Even persons who say they do not buy souvenirs will readily admit that they do not buy them for themselves but rather for others. Usually, a person traveling to a famous destination on business or vacation while leaving a spouse or other loved one at home frequently would be found greatly remiss if he or she returned home without a souvenir of the location to present to the person who stayed home.

Unfortunately, souvenirs are often large and bulky and, when purchased early during the trip, must be lugged around until the end of the trip and ultimately packed into the traveler's luggage, which increases the bulk and weight of the luggage and poses a substantial risk that the souvenir will be damaged during the trip home.

SUMMARY

In view of the conventional situation as summarized above, multipurpose souvenir kits are provided that overcome these disadvantages because the kits are compact in their disassembled form and the constituent parts can be assembled together in various ways to form different assemblies each comprising a respective combination and assembly of parts. The assemblies, which are individually selectable by the possessor of the kit, include one or more assemblies having appeal as souvenir items.

A souvenir kit according to one embodiment comprises an assortment of multiple parts that include a front member, a rear member, and at least one side member. At least the front member is thematically representative of an aspect of a particular travel destination. Also, at least the front member is configured for connection to one or more other parts in the kit in multiple respective ways so as to make a selected souvenir assembly of at least three possible souvenir assemblies, each having a different use, that can be made from the parts in the kit.

The kit can include, for example, one or more of a base member, a second side member, at least one wall-hanging support, and assembly hardware such as screws, nails, hooks, and the like, as needed for making any of the possible souvenir assemblies.

In one embodiment, the kit can be configured such that a selected any of at least four possible souvenir assemblies can be made from the parts in the kit. In another embodiment, the kit can be configured such that a selected any of at least five possible souvenir assemblies can be made from the parts in the kit.

A kit according to another embodiment comprises multiple parts including a front member, a rear member, a base member, and at least one side member. At least the front member is thematically representative of the travel destination, and at least the front member is configured for connection to at least one other part in the kit in multiple ways so as to form, with the front member and at least one other of the parts of the kit, a selected one of at least two souvenir assemblies. The souvenir assemblies that can be made from the kit include bookends, wall-hangings, enclosures, light-switch covers, object-holding devices, wind chimes, and combinations of these assemblies. In the kit the front member, rear member, base member, and at least one side member all can be thematically representative of the aspect of the travel destination.

In the case of the selectable souvenir assemblies including the enclosure, the enclosure can be assembled, at least in part, by attaching the front and rear members perpendicularly to the side members and perpendicularly to the base member serving as a bottom of the enclosure. In a particular embodiment, at least the front and rear members can define respective slots extending along respective side edges of the members, and the side members can have lateral edges configured to slide into the slots, wherein the enclosure is assembled, at least in part, by inserting the lateral edges into the respective slots. In addition or alternatively, respective slots can be defined near respective bottom edges of the front member, rear member, and side members, and the base member can have lateral edges configured to slide into the slots near the respective bottom edges, wherein the enclosure is assembled, at least in part, by inserting the lateral edges of the base member into the slots near the respective bottom edges.

In the case of the selectable souvenir assemblies including the wall-hanging, the wall-hanging can be assembled, at least in part, by attaching wall-hanging supports to a second surface of the base member or of the front member. In another example the wall-hanging can be assembled by attaching the front member and rear member to a first surface of the base member. The kit further can include at least one wall-hanging support.

In the case of the selectable souvenir assemblies including the light-switch cover, the kit further can include at least one light-switch cover-plate that can be mounted at least to the front member. The kit further can include at least one object-hanging component (e.g., a hook) for attachment to a lower edge of the light-switch cover, such as to the lower edge of the front member.

In the case of the selectable souvenir assemblies including the wind chime, the kit further can include a hanger for hanging the wind chime so as to make a hanging wind chime. The kit further can include at least one chime configured to be struck by movement associated with air flow being directed at the chime, and a corresponding number of the chime-attachment devices (e.g., eyelets). In a particular embodiment the wind-chime assembly can be assembled, at least in part, by attaching the front member back-to-back to the rear member.

In the case of the selectable souvenir assemblies including the bookends, the kit further can include bookend supports for attachment to the front and rear members, respectively, for example. A set of bookends can be assembled by, for example, attaching the front member perpendicularly to a first bookend support and attaching the rear member perpendicularly to a second bookend support.

In the case of the selectable souvenir assemblies including the object-holding device, the object-holding device can be assembled by, for example, attaching at least one hook to a lower edge surface of the front member (or to the lower edge surface of the base member to which the front member is attached). The hook can be configured to hold an object, and the front member can be configured for attachment to a support surface.

The kit can be configured such that the members can be assembled into a selected any one of at least three, at least four, or all of the souvenir assemblies.

The aspect of the particular travel destination to which the selectable souvenirs are thematically correlated can be, for example, any of the following: architectural entities, man-made features, natural features, environmental settings, plants, animals, events, persons, fictional places, and fictional characters, and combinations thereof.

According to another aspect, methods are provided for promoting sales of souvenirs, thematically correlated to a particular travel destination, from a sales establishment. An embodiment of such a method comprises providing a kit of parts comprising an assortment of multiple parts including a front member, a rear member, and at least one side member, wherein at least the front member is thematically representative of an aspect of a particular travel destination, and at least the front member is configured for connection to one or more other parts in the kit in multiple respective ways so as to make a selected souvenir assembly of at least three possible souvenir assemblies that can be made from the parts in the kit. The kit is presented for sale at the sales establishment. In another embodiment the kit presented for sale at the sales establishment includes a front member, a rear member, at least one side member, and a base member, wherein at least the front member is thematically representative of the travel destination, and wherein certain members are configured for connection to at least some of the other members in multiple ways so as to form one of at least two souvenir assemblies as selected by a possessor of the kit. The souvenir assemblies can be selected from a set of bookends, a wall-hanging, an enclosure, a light-switch cover, an object-holding device, and a wind chime.

The foregoing and additional features and advantages of the invention will be more readily apparent from the following detailed description, which proceeds with reference to the accompanying drawings.

BRIEF DESCRIPTION OF THE DRAWINGS

FIG. 6 is a front orthogonal view depicting an assembly of certain of the constituent parts of the kit of FIG. 1 into a light-switch cover that optionally includes hooks for keys or the like.

FIG. 11 is a front orthogonal view of a front member having a different thematic representation than the front member of the kit shown in FIG. 1.

DETAILED DESCRIPTION

The disclosure is set forth below in the context of a representative embodiment that is not intended to be limiting in any way. The representative embodiment is described with reference to figures that are not intended to limit the scope of the disclosure.

Reference throughout this description to a "representative embodiment" means that a particular feature, structure, or characteristic described in connection with the embodiment is included in at least one possible embodiment of the subject kits, but not necessarily in all possible embodiments. The described features, structures, and/or characteristics of the representative embodiment can be combined in any of various suitable manners in the one or more possible embodiments. One skilled in the relevant art will recognize that one or more possible embodiments can be practiced without one or more of the specific details and/or features in the representative embodiment, or can be practiced with other methods, components, materials, and so forth. In other instances, well-known structures, materials, or operations are not shown or described in detail to avoid unnecessary detail.

Figure 1:
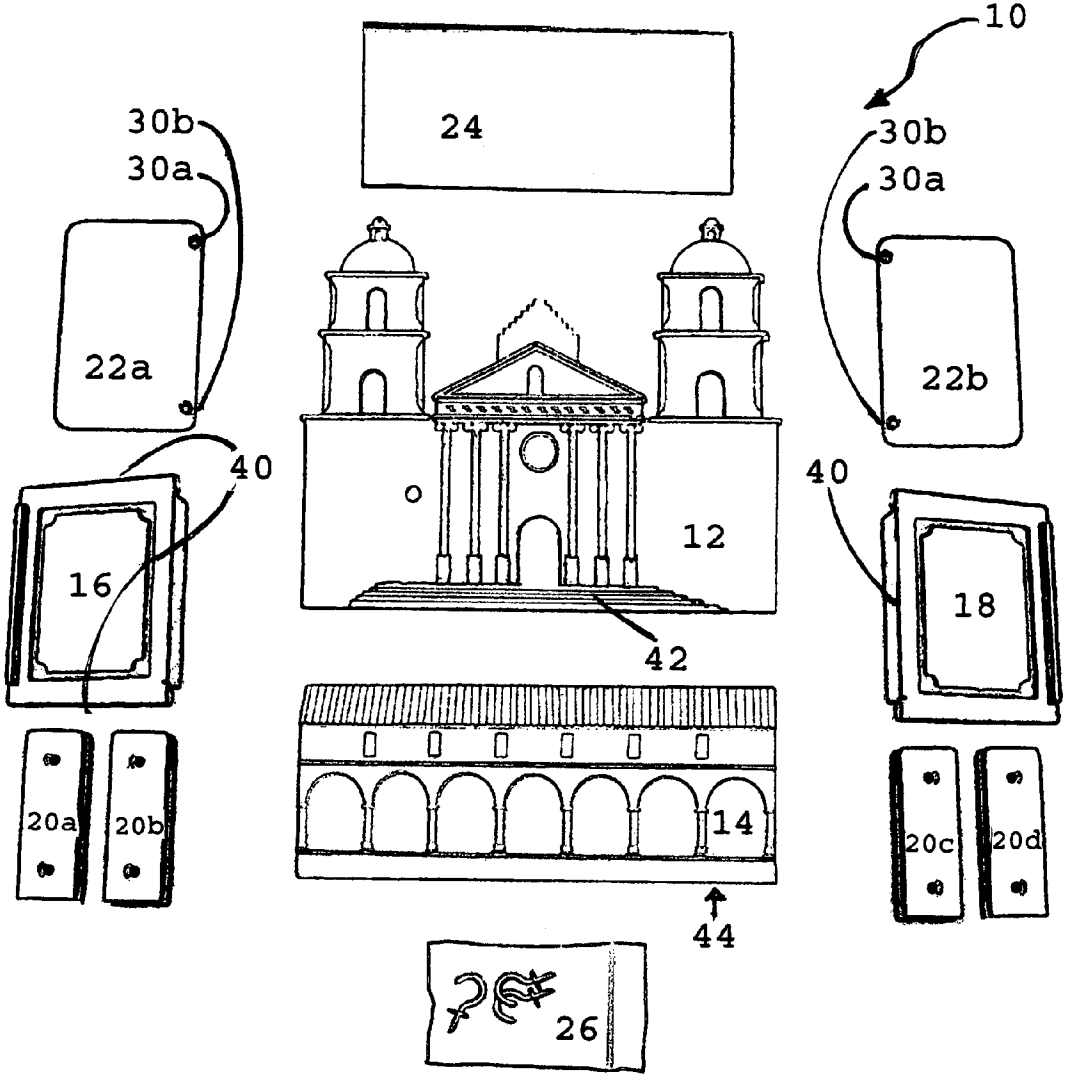
FIG. 1 is a plan view depicting a group of component parts that may be included in a kit according to the representative embodiment. Certain of the parts have an exemplary thematic configuration corresponding to a particular travel destination.

Referring first to FIG. 1, exemplary constituent parts of a kit 10 according to a representative embodiment are shown. The kit comprises a front member 12, a rear member 14, a first side member 16, and a second side member 18. These parts in this particular embodiment have, by way of example, a thematic "mission" motif which is representative of a particular travel location. The kit 10 can include additional components such as wall-hanging supports 20*a*-20*d*, bookend supports 22*a*, 22*b*, a base member 24, and a hardware assortment 26 including, for example, screws, nails, hooks, and the like as required. Each component of the kit 10 is configured for attachment to another component to form a particular souvenir assembly, or to serve a particular utilitarian purpose associated with construction, use, or mounting of one or more particular souvenir assemblies. Not all possible souvenir assemblies that can be constructed using the kit 10 necessarily utilize all the parts shown in FIG. 1 or otherwise supplied with the kit 10. The major parts of the depicted kit 10, notably the front member 12, the rear member 14, the side members 16, 18, the base member 24, and the wall-hanging supports 20*a*-20*d*, can be made, for example, of wood, rigid plastic, ceramic, metal, or other suitable material. The bookend supports 22*a*, 22*b* desirably are made of metal, e.g., brass. The various parts can be made of different materials if desired or required.

Figure 2:
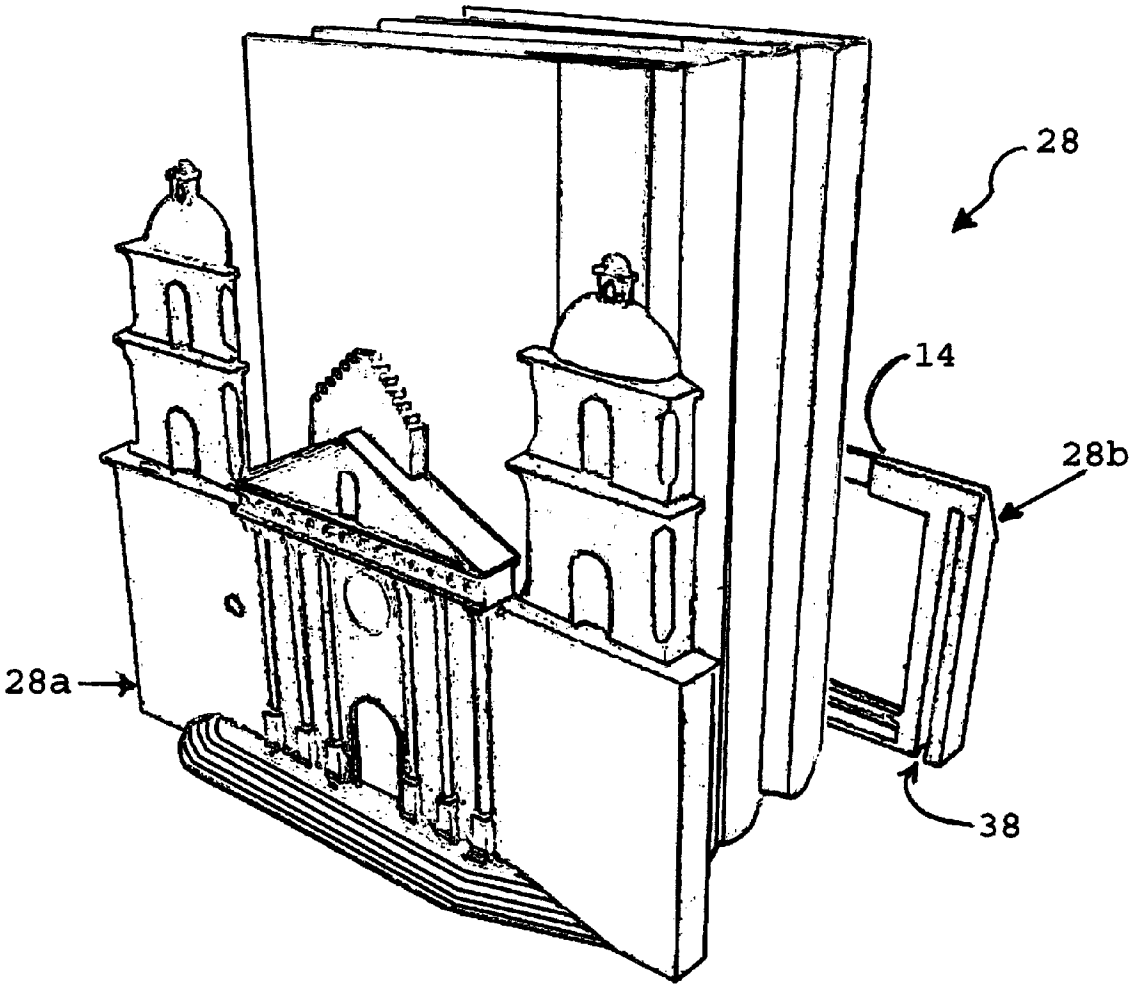
FIG. 2 is a perspective view depicting an assembly of certain of the constituent parts of the kit of FIG. 1 into a pair of bookends holding a group of books.
Figure 3:
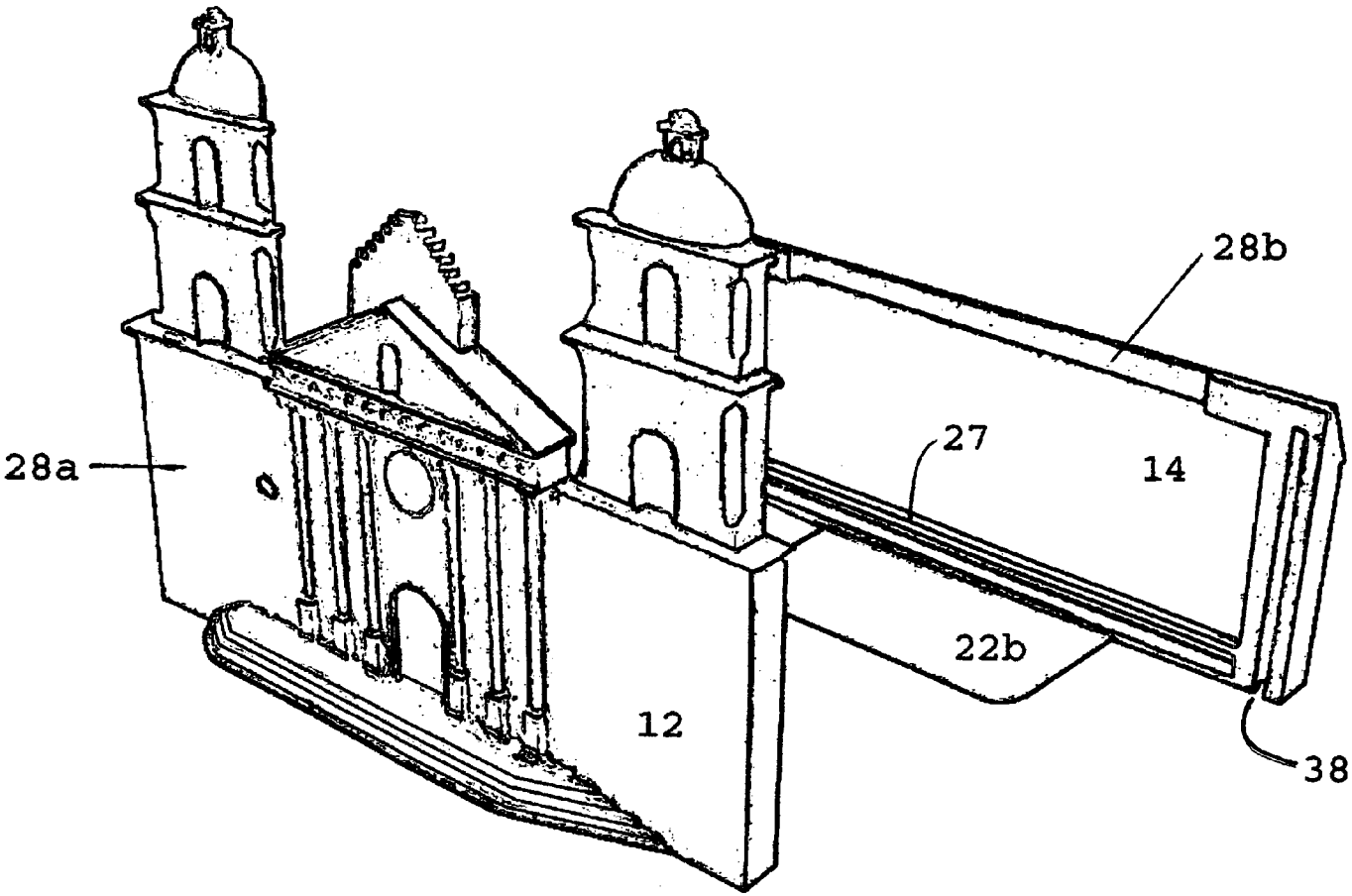
FIG. 3 is a perspective view of the bookends of FIG. 2 but with the books removed to show otherwise hidden detail.

FIGS. 2 and 3 depict one exemplary souvenir assembly, namely a pair of bookends 28, that can be made from at least some of the parts of the kit 10 shown in FIG. 1. Specifically, the bookends 28 comprise a first bookend 28*a* and a second bookend 28*b*. The first bookend 28*a* is an assembly of the front member 12 and one bookend support 22*a,* and the second bookend 28*b* is an assembly of the rear member 14 and the other bookend support 22*b*. In this assembly, each bookend support 22*a,* 22*b* is attached to the bottom edge of the respective member 12, 14 by screws. To such end, the bookend supports 22*a,* 22*b* define fastener apertures 30*a,* 30*b,* respectively. Alternatively to screws, the bookend supports 22*a,* 22*b* can be attached to the respective members 12, 14 by any of various other fastening schemes including, but not limited to, glue, clamps, clasps, nails, etc.

Figure 4:
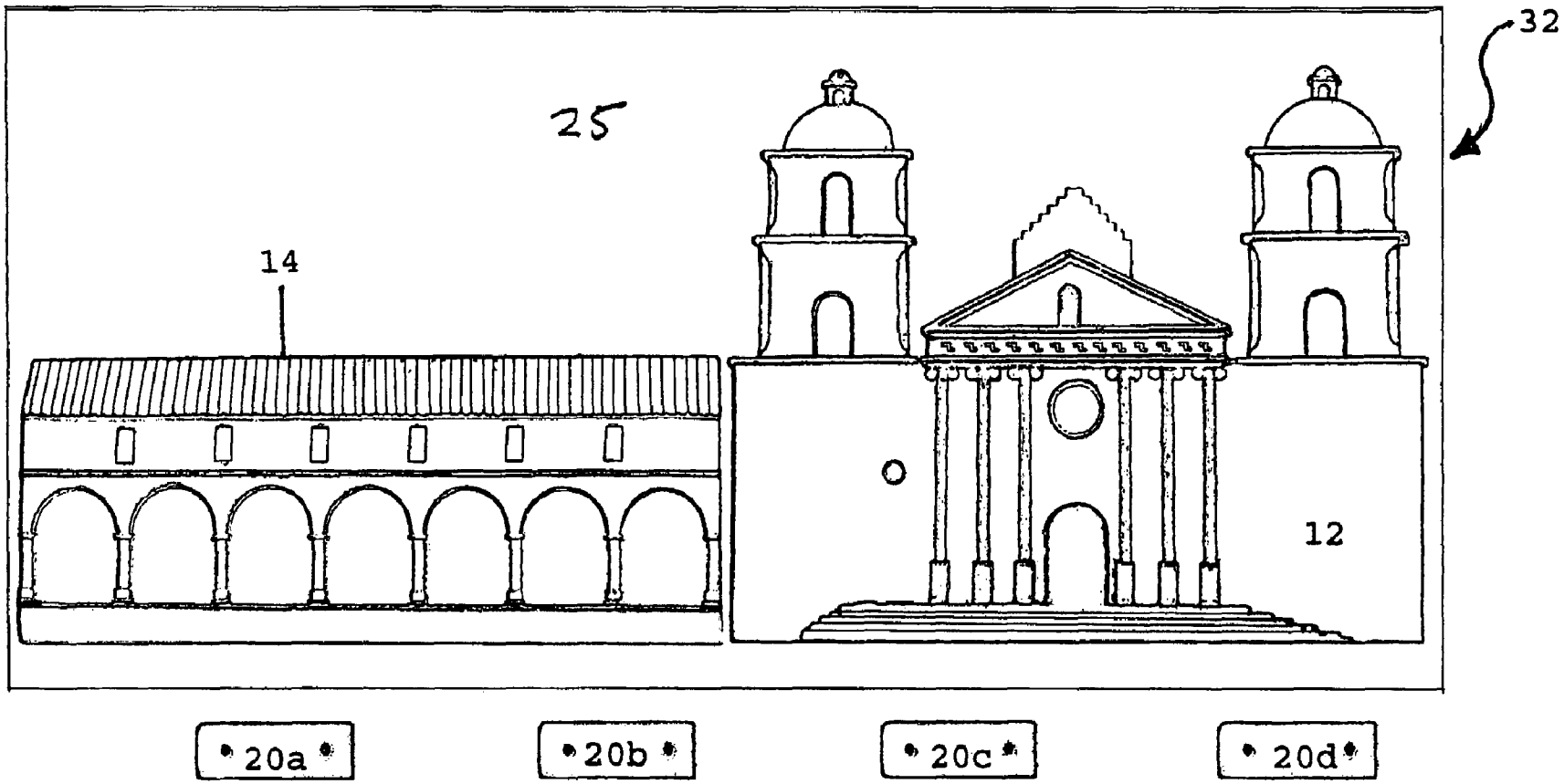
FIG. 4 is a front orthogonal view depicting an assembly of certain of the constituent parts of the kit of FIG. 1 into a wall-hanging.

FIG. 4 depicts another exemplary souvenir assembly, namely a wall-hanging 32, that can be made from at least some of the parts of the kit 10 shown in FIG. 1. Specifically, the depicted wall-hanging 32 comprises at least the front member 12, the rear member 14, and the base member 24 assembled together. To make the assembly, the front member 12 and rear member 14 can be glued, screwed, nailed, or attached in any other suitable manner, to the base member 24. The front member 12 and rear member 14 may be positioned relative to each other in the manner depicted or can be mounted with their respective positions reversed from what is shown. An appropriately sized base member 24 advantageously can serve as a backing plate, which is a role that the base member 24 can serve alone or in combination with one or more of the side members 16, 18, if desired.

Figure 10:
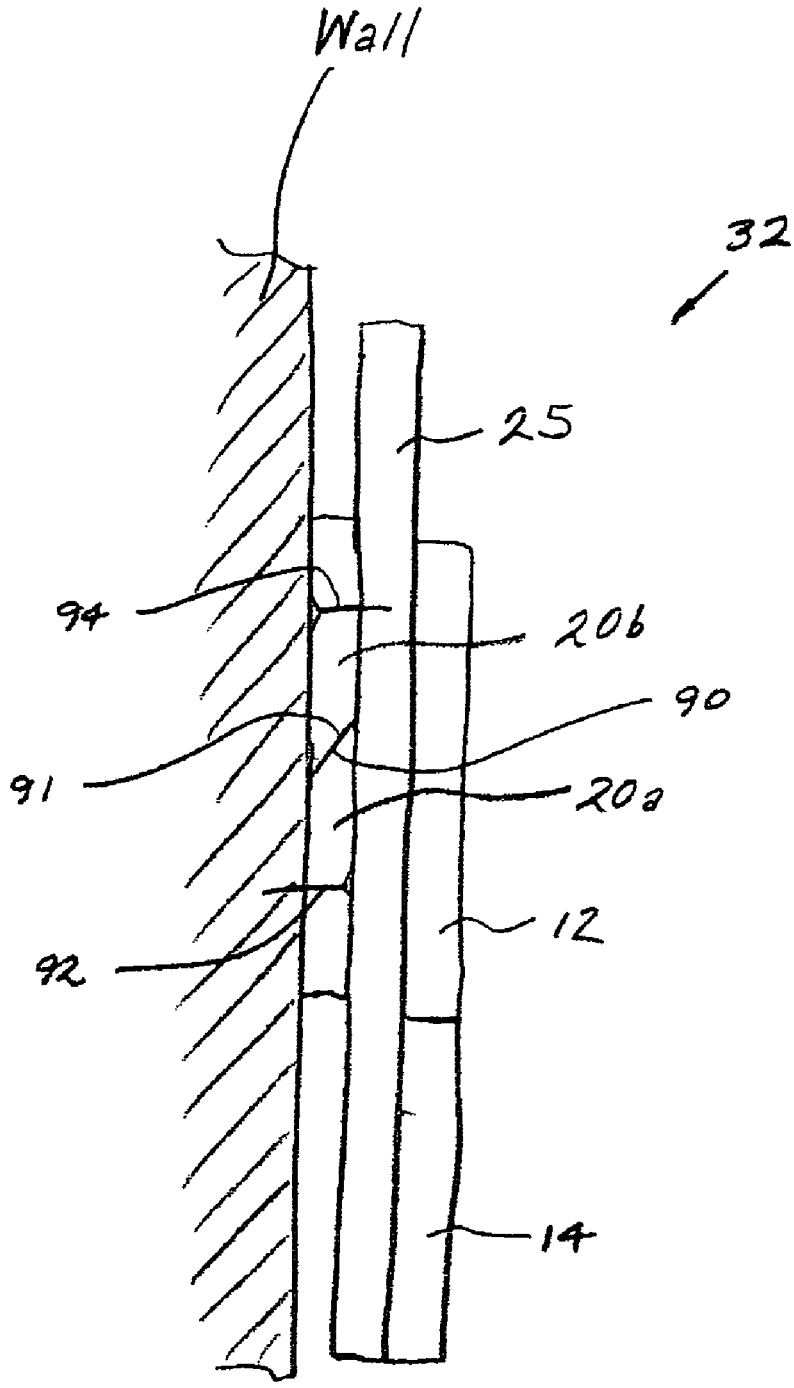
FIG. 10 is a side elevational view showing an exemplary manner in which the wall-hanging of FIG. 4 can be attached to a wall.

The wall-hanging supports 20*a*-20*d* desirably are configured to be screwed or otherwise fastened to a wall, and thus one or more of the supports can be used for supporting the wall-hanging 32. For example, the base member 24 can be provided with extensions or analogous features on its reverse side that are configured to engage the wall-hanging supports 20*a*-20*d.* The extensions can be configured simply to rest on the wall-hanging supports 20*a*-20*d,* or the wall-hanging supports 20*a*-20*d* can be configured to provide a friction fit around the extensions. In another example, as shown in FIG. 10, at least two of the wall-hanging supports 20*a*-20*d* have angled edges 90, 91, wherein a first wall-hanging support 20*a* is mounted to a wall, e.g., by one or more screws 92, with the angled edge 90 oriented upward. A second wall-hanging support 20*b* is mounted to the rear of the base member 24, e.g., by one or more screws 94, with the angled edge 91 oriented downward. To mount the wall-hanging 32 on the wall, the wall-hanging is simply placed such that the angled edge 90 rests on the angled edge 91.

Figure 5:
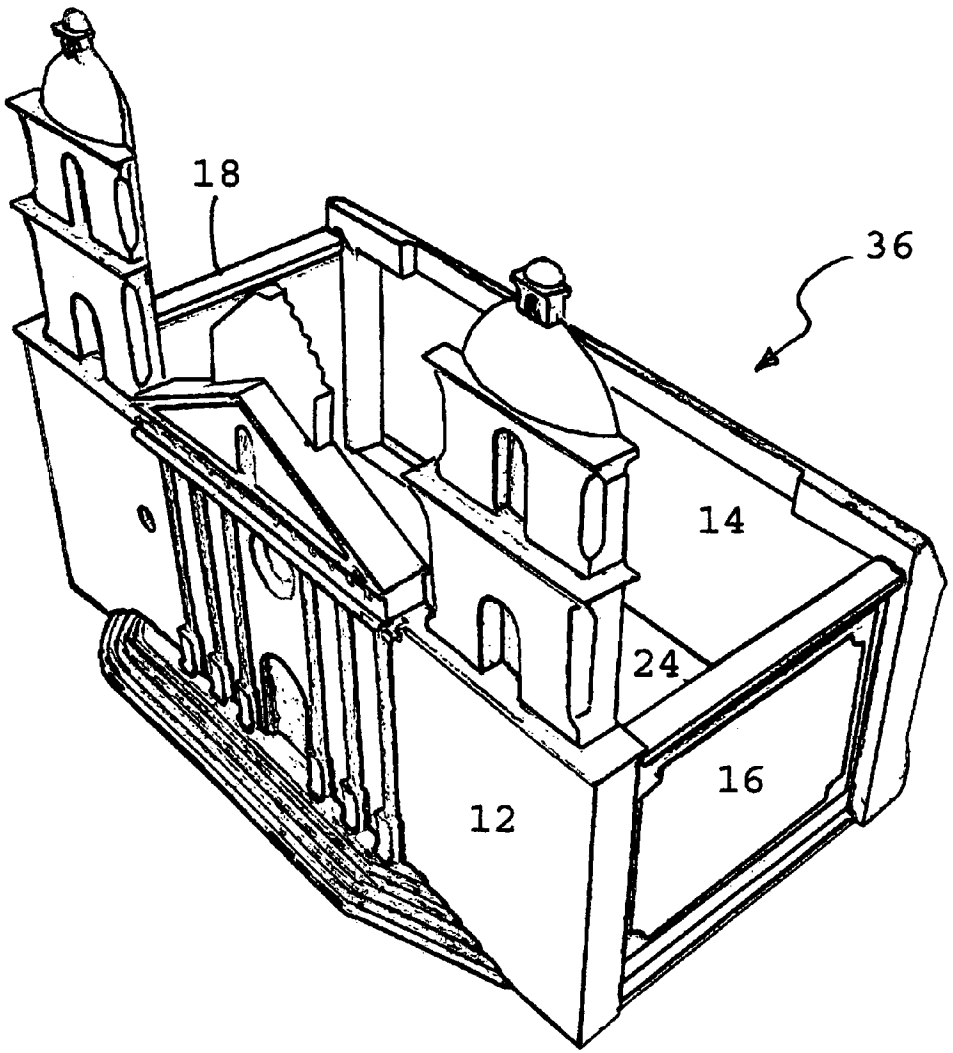
FIG. 5 is a perspective view depicting an assembly of certain of the constituent parts of the kit of FIG. 1 into a planter unit or analogous container or box.

FIG. 5 depicts yet another exemplary assembly, namely an enclosure or container 36 (usable, e.g., as a planter), that can be made from at least some of the parts shown in FIG. 1. The enclosure 36 comprises the front member 12, the rear member 14, the side members 16, 18, and the base member 24. For ease of assembly, the front member 12 and rear member 14 desirably define tapered slots 38 (see FIG. 3) on their respective rear surfaces adjacent lateral edges of the members. The tapered slots 38 are configured to receive respective edges 40 (see FIG. 1) of the side members 16, 18, wherein the edges 40 are configured to slide or otherwise be inserted into the respective slots 38. For example, the edges 40 of the side members 16, 18 slide into the tapered slots 38 of the front member 12 and rear member 14 from the bottom edges 42, 44 (see FIG. 1) of the front and rear members 12, 14, respectively. To hold the assembly together, the edges 40 can be glued, nailed, screwed, friction-fit, etc., in their respective slots 38.

For additional structural integrity of the enclosure 36, respective slots (not shown, but similar to the slots described above) can be defined near the bottom edge 42 of the front member 12, near the bottom edge 44 of the rear member 14, and near the bottom edges 46, 48 of the side members 16, 18 for receiving corresponding edges of the base member 24. To hold the assembly together, the edges of the base member 24 can be glued, nailed, screwed, friction-fit, etc., in their respective slots. Indeed, the edges of the base member 24 can be simply fit into the respective slots and held there as a result of other structural integrity provided by assembling the edges 40 into respective slots 38 as described above.

Although the assembly shown in FIG. 5 is described in the context of being usable as a "planter enclosure," it will be immediately comprehended that the assembly can be used generally as a box or the like for enclosing any of various items or simply used and enjoyed without having the structure contain anything.

Figure 6:
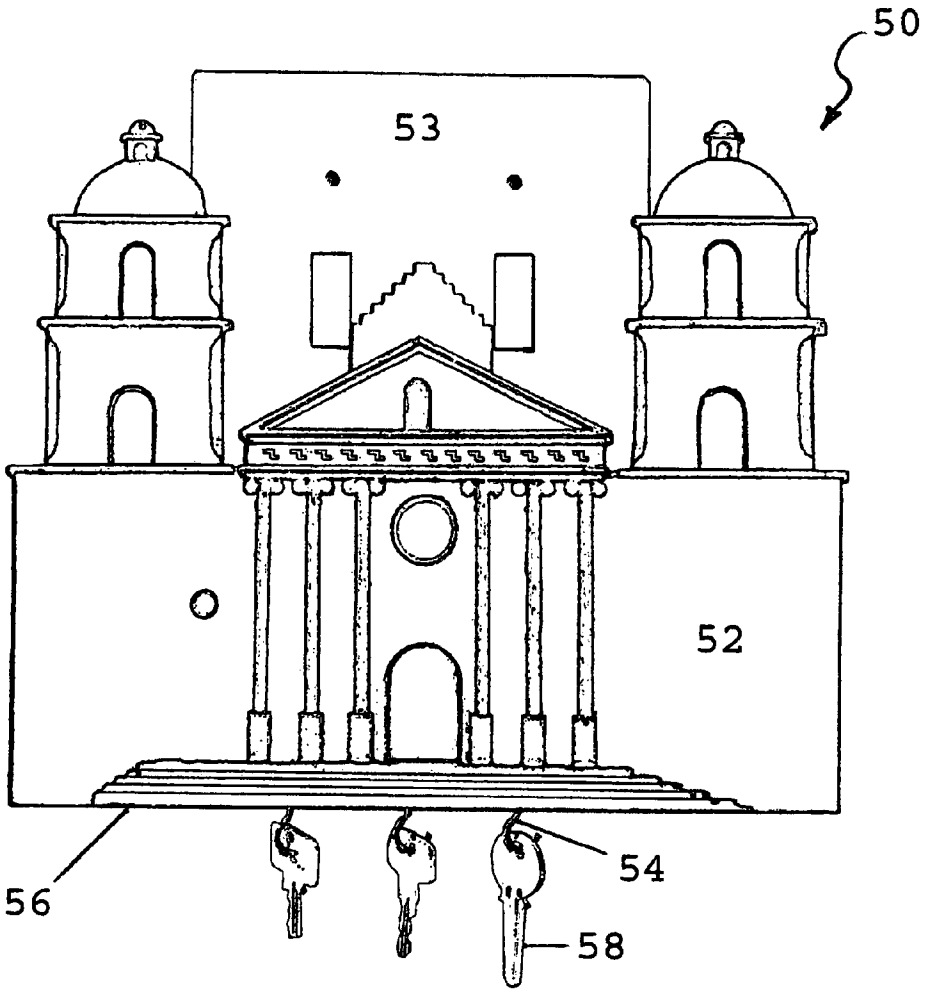

FIG. 6 depicts yet another exemplary assembly, namely a light-switch cover 50, that can be made from at least some of the parts shown in FIG. 1. The light-switch cover 50 includes a conventional light-switch cover plate 52 (shown as a two-gang cover plate), and the front member 12. Although the depicted light-switch cover 50 has the cover plate 52 situated above the front member 12, in an alternative configuration the cover plate 52 can be located below the front member 12, for example. Optionally, as shown, the light-switch cover 50 can include one or more hooks 54 (or other object-hanging components) threaded into, for example, the bottom edge 56 of the front member 12 and used for, e.g., holding keys 56, cups, or other objects. Of course, the cover plate 52 is not limited to the two-gang, toggle-switch cover shown; it alternatively can be sized for different numbers of switches and/or for different types of switches. The cover plate 52 can be provided separately by the purchaser of the kit 10 or provided as a constituent part in the kit. In this regard, the kit 10 can include multiple cover plates 52 each configured to cover different types and numbers of switches. The depicted assembly 50 can be made without the hooks 54. Further alternatively, the assembly 50 can be used, without the cover plate 52, as a wall-hanging with or without the hooks 54.

Figure 7:
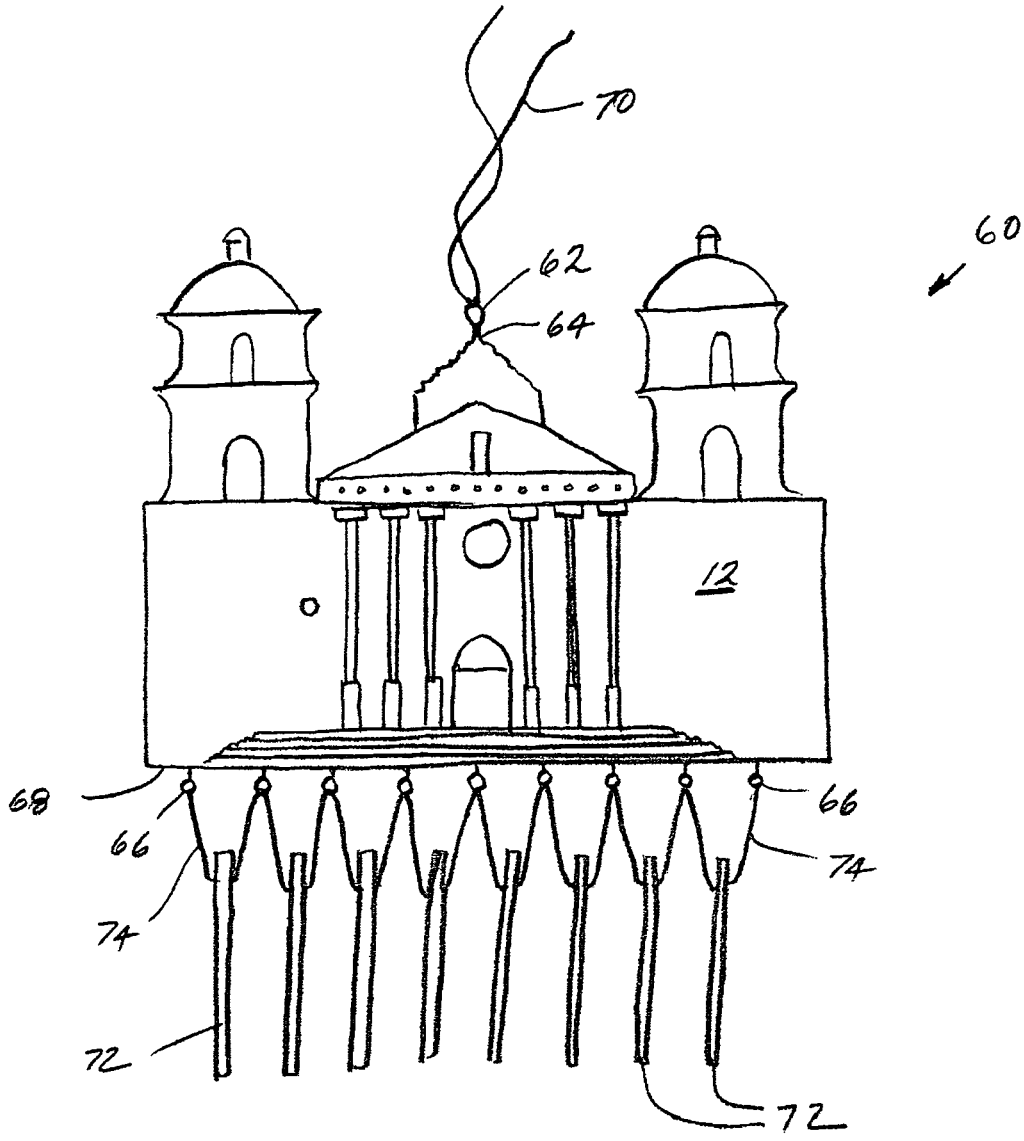
FIG. 7 is a front orthogonal view depicting an assembly of certain of the constituent parts of the kit of FIG. 1 into a wind chime.
Figure 8:
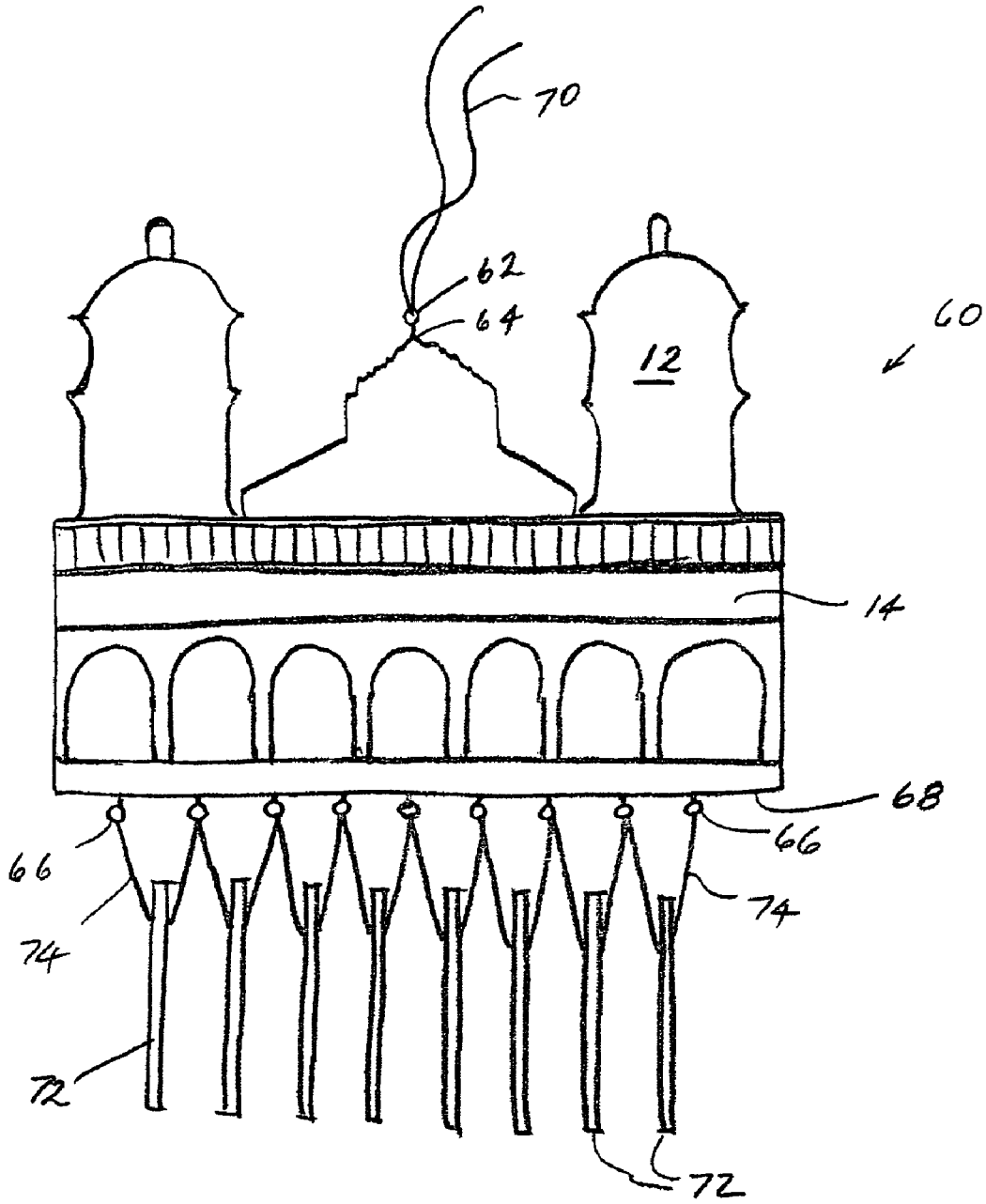
FIG. 8 is a rear orthogonal view of the wind-chime assembly shown in FIG. 7.
Figure 8:
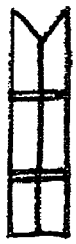

FIGS. 7 and 8 depict yet another exemplary assembly, namely a wind chime 60, that can be made from at least some of the parts shown in FIG. 1. FIG. 7 depicts a front view, and FIG. 8 depicts a rear view of the wind chime 60. The wind chime 60 includes the front member 12 and the rear member 14 attached to each other back-to-back. An eyelet (e.g., screw eyelet) 62 is attached to the center upper edge 64, and an array (e.g., linear array) of eyelets 66 (e.g., screw eyelets) are attached along the bottom edge 68. The wind chime 60 can be hung from any of various existing structures via the top eyelet 62 using a cord (shown) 70 or analogous hanging means. The back-to-back arrangement of the front and rear members 12, 14 allows the thematic aspect of the souvenir to be recognizable no matter the direction in which the wind chime 60 is facing relative to a viewer. The front member 12 and rear member 14 can be assembled together in this manner using the wall-hanging supports 20*a*-20*d* and/or by using any suitable securing means such as, but not limited to, nails, glue, screws, clasps, friction-fitting rods, etc.

A set of chimes 72 is hung from the eyelets 66 using one or more hangers 74, such as string, twine, chain, or the like. A single hanger 74 can be used to attach all the chimes 72. Alternatively each chime 72 can be hung from a respective eyelet 66 using a respective hanger 74. Further alternatively, the chimes 72 can be hung in selected groups using respective hangers 74.

It will be understood that the chimes 72 can be attached to any of the other assemblies that can be made from the parts of the kit 10, especially if the assembly is configured to be hung.

Figure 9:
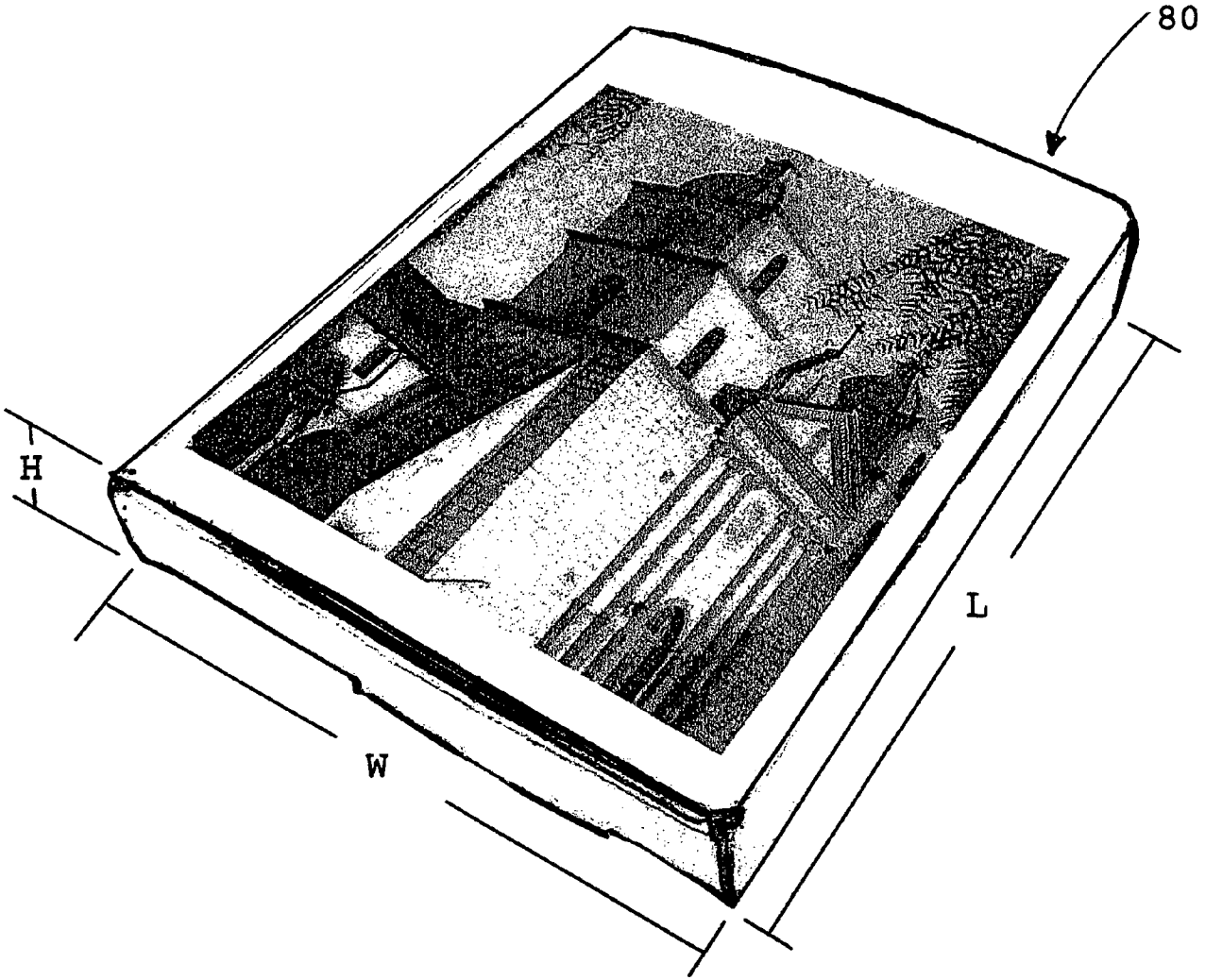
FIG. 9 is a perspective view of an exemplary carton configured to hold the kit of FIG. 1.

FIG. 9 depicts an exemplary carton 80 that can be used for packing and containing the kit 10. The depicted carton 80 desirably is made of cardboard (such as corrugated cardboard). By way of example, and not intending to be limiting in any way, the carton 80 has interior dimensions as follows: height "H" of ⅜ inch, length "L" of 9¼ inches, and width "W" of 6⅞ inches. One of ordinary skill in the art will appreciate that components of the kit 10 can be produced in any of various sizes and from any of various materials; hence, the carton 80 desirably is dimensioned accordingly so as to hold the kit 10 compactly and securely to facilitate shipping, transportation, and mobility.

The kit 10 can contain any of various other parts such as, but not limited to, screws, nails, glue, string, paint, clips, etc., as required or desired. The kit 10 also can contain assembly instructions, or alternatively the instructions can be printed on the carton 80, for example.

Additionally, although the disclosure above generally discusses the various assemblies as being rectilinear, L-shaped (bookends), or substantially flat (wall-hanging), it will be understood that these general configurations are exemplary only. Alternatively, any of the assemblies can have various other shapes and configurations such as circular, polygonal, or the like. The constituent parts of the kit can be fashioned for any size and packed into an appropriate carton.

It also is contemplated that certain constituent parts of the kit can be pre-assembled to allow the kit to exist in a "collapsed" form or state (suitable for packaging and/or shipping) and in an "assembled" form or state (suitable for when the purchaser has returned home). For example, referring to the array of parts shown in FIG. 1, a kit as actually marketed could have the side members 16, 18 at least partially pre-assembled to the front member 12 and/or the rear member 14 in a manner (e.g., by hinges, creases, or analogous means) allowing the side members to be folded flat against the front member and/or rear member, representative of the collapsed state, and opened up for an expanded state. Alternatively, for example, the side members 16, 18 could be made telescopic or accordion-folded so as to expand front-to-back for assembly but be in a retracted (collapsed) state for packaging and/or shipping of the kit. The collapsed state can be characterized by a reduced depth dimension, relative to width and length dimensions of a possible souvenir assembly that can be produced from at least some of the constituent parts of the kit.

Although FIGS. 1-10 depict assemblies thematically representing a "mission" (as the exemplary locale from which the souvenir ostensibly was obtained), it will be appreciated that the thematic representation alternatively could be any motif, such as another architectural site, a tourist site, a natural scene, a symbol, or a character (e.g., a theme-park character). For example, FIG. 11 depicts a front member 100 that is thematically representative of a cable car, such as characteristic of San Francisco. It also will be appreciated that the kits can be marketed anywhere such as at or near the corresponding location represented by the assemblies. For example, a kit for constructing a miniature Leaning Tower of Pisa could be sold in Pisa or in Italy, or a kit for constructing a miniature Eiffel Tower could be sold in Paris or in France. Small-sized kits would encourage tourists to purchase kits at their points of sale because small size allows for easy packing and transportation of one or multiple kits. Naturally, per-kit postage for mailing multiple kits from a particular location would be lower than for mailing a single kit. It is envisioned that souvenir-shop owners could easily handle the postage at the shop location, and known postage costs to various countries could be printed directly on the carton containing the kit. Due to the simplicity of mailing the kits from a shop location, it is envisioned that shop owners would appreciate increased sales overall as well as increased sales per customer due to the compactness of the kit.

It is also contemplated that there would be a market for a smaller kit, in at least one direction, such as the height. The kit height could be reduced by using flexible compressible foam, (such as urethane foam, Styrofoam, or memory foam, for example) such that it could be compressed when packaged, and then opened, it would expand to size, thereby becoming fully filled out.

The total kit height can be compressed, as an example, to approximately ⅜" in the package but once the package is opened, the kit could expand to full-size of approximately 1⅜", thereby making the various pieces multidimensional. The various pieces of the kit, once assembled, would have the appearance of those of the previously de-scaled package. Such packaging would allow for much smaller packages when shipping, storing, marketing and after sales transporting but would have totally different appearances when unpackaged and assembled due to expanding in, at least, one direction.

The features and configurations described above are exemplary only. Other embodiments and configurations are possible without departing from essential characteristics and spirit of this disclosure. For example, aside from the various alternatives discussed above, any of various modifications can be implemented including variations in size, materials, shape, form, function, manner of operation, assembly, and use can be made without departing from the principles and concepts of the subject of this disclosure.

What is claimed is:

1. A kit for assembly into multiple selectable souvenirs thematically associated with an aspect of a particular travel destination, the kit comprising:

multiple parts including a front member, a rear member, a base member, and at least one side member, wherein at least the front member is thematically representative of the travel destination and at least the front member is configured for connection to at least one other part in the kit in multiple ways so as to form, with the front member and at least one other of the parts of the kit, a selected one of at least two physically distinct souvenir assemblies, the souvenir assemblies being selected from the group consisting of:

(a) bookends;

(b) wall-hangings;

(c) planter boxes;

(d) light-switch covers;

(e) object-holding devices;

(f) wind chimes; and (g) combinations thereof;

wherein the selectable souvenir assemblies include the planter boxes and the light-switch covers, and wherein the planter box is assembled, at least in part, by attaching the front and rear members perpendicularly to the side members and perpendicularly to the base member serving as a bottom of the planter box.

2. A kit for assembly into multiple selectable souvenirs thematically associated with an aspect of a particular travel destination, the kit comprising:

multiple parts including a front member, a rear member, a base member, and at least one side member, wherein at least the front member is thematically representative of the travel destination and at least the front member is configured for connection to at least one other part in the kit in multiple ways so as to form, with the front member and at least one other of the parts of the kit, a selected one of at least two physically distinct souvenir assemblies, the souvenir assemblies being selected from the group consisting of:

(a) bookends;
(b) wall-hangings;
(c) planter boxes;
(d) light-switch covers;
(e) object-holding devices;
(f) wind chimes: and
(g) combinations thereof;

wherein the selectable souvenir assemblies include the planter boxes and the light-switch covers, and wherein at least the front and rear members define respective slots extending along respective side edges of the members;

the side members have lateral edges configured to slide into the slots; and the planter box is assembled, at least in part, by inserting the lateral edges of the side members into the respective slots.

3. The kit of claim 2, wherein:

respective slots are defined near respective bottom edges of the front member, rear member, and side members;

the base member has lateral edges configured to slide into the slots near the respective bottom edges; and the planter box is assembled, at least in part, by inserting the lateral edges of the base member into the slots near the respective bottom edges.

4. A kit for assembly into multiple selectable souvenirs thematically associated with an aspect of a particular travel destination, the kit comprising:

multiple parts including a front member, a rear member, a base member, and at least one side member, wherein at least the front member is thematically representative of the travel destination and is configured for connection to at least one other part in the kit in multiple ways so as to form, with the front member and the at least one other part, a selected one of at least two physically distinct souvenir assemblies, the souvenir assemblies being selected from the group consisting of:

(a) bookends;
(b) wall-hangings;
(c) enclosures;
(d) light-switch covers;
(e) object-holding devices;
(f) wind chimes; and
(g) combinations thereof;

wherein the selectable souvenir assemblies include the wind chime, and the kit further comprises a hanger for hanging the wind chime so as to make a hanging wind chime.

5. A kit for assembly into multiple selectable souvenirs thematically associated with an aspect of a particular travel destination, the kit comprising:

multiple parts including a front member, a rear member, a base member, and at least one side member, wherein at least the front member is thematically representative of the travel destination and is configured for connection to at least one other part in the kit in multiple ways so as to form, with the front member and the at least one other part, a selected one of at least two physically distinct souvenir assemblies, the souvenir assemblies being selected from the group consisting of:

(a) bookends;
(b) wall-hangings;
(c) enclosures;
(d) light-switch covers;
(e) object-holding devices;
(f) wind chimes; and
(g) combinations thereof;

wherein the selectable souvenir assemblies include the wind chimes and the kit further comprises at least one chime configured to be struck by movement associated with air flow being directed at the chime, and a corresponding number of chime-attachment devices.

6. The kit of claim 5, wherein the chime-attachment devices comprise respective eyelets.

7. A kit for assembly into multiple selectable souvenirs thematically associated with an aspect of a particular travel destination, the kit comprising:

multiple parts including a front member, a rear member, a base member, and at least one side member, wherein at least the front member is thematically representative of the travel destination and is configured for connection to at least one other part in the kit in multiple ways so as to form, with the front member and the at least one other part, a selected one of at least two physically distinct souvenir assemblies, the souvenir assemblies being selected from the group consisting of:

(a) bookends;
(b) wall-hangings;
(c) enclosures;
(d) light-switch covers;
(e) object-holding devices;
(f) wind chimes; and
(g) combinations thereof;

wherein the selectable souvenir assemblies include the wind chimes, and the wind chime is assembled, at least in part, by attaching the front member back-to-back to the rear member.

8. A kit for assembly into multiple selectable souvenirs thematically associated with an aspect of a particular travel destination, the kit comprising:

multiple parts including a front member, a rear member, a base member, and at least one side member, wherein at least the front member is thematically representative of the travel destination and is configured for connection to at least one other part in the kit in multiple ways so as to form, with the front member and the at least one other part, a selected one of at least two physically distinct souvenir assemblies, the souvenir assemblies being selected from the group consisting of:

(a) bookends;
(b) wall-hangings;
(c) enclosures;
(d) light-switch covers;
(e) object-holding devices;
(f) wind chimes; and
(g) combinations thereof;

wherein the members can be assembled into a selected any one of all the souvenir assemblies.

* * * * *